US005317118A

United States Patent [19]

Brandberg et al.

[11] Patent Number: 5,317,118

[45] Date of Patent: * May 31, 1994

[54] PACKAGE WITH MICROWAVE INDUCED INSULATION CHAMBERS

[75] Inventors: Lawrence C. Brandberg, Edina; Jeffrey T. Watkins, Eden Prairie, both of Minn.

[73] Assignee: Golden Valley Microwave Foods Inc., Edina, Minn.

[ * ] Notice: The portion of the term of this patent subsequent to Jan. 14, 2009 has been disclaimed.

[21] Appl. No.: 831,551

[22] Filed: Feb. 5, 1992

[51] Int. Cl.[5] ..... H05B 6/80; B65B 25/22

[52] U.S. Cl. ..... 219/727; 219/730; 99/DIG. 14; 426/107; 426/111; 426/234; 426/243

[58] Field of Search ..... 219/10.55 E, 10.55 F, 219/10.55 M; 426/107, 110, 113, 115, 123, 124, 234, 243; 99/DIG. 14; 206/46, 484

[56] References Cited

U.S. PATENT DOCUMENTS

| | | | |
|---|---|---|---|
| 3,098,563 | 7/1963 | Skees | 206/46 |
| 3,549,381 | 12/1970 | Kinsinger | 426/115 |
| 4,132,811 | 1/1979 | Standing et al. | 426/111 |
| 4,190,757 | 2/1980 | Turpin et al. | 219/10.55 E |
| 4,196,331 | 4/1980 | Leveckis et al. | 219/10.55 E |
| 4,219,573 | 8/1980 | Borek | 426/107 |
| 4,316,070 | 2/1982 | Prosise et al. | 219/10.55 E |
| 4,553,010 | 11/1985 | Bohrer et al. | 219/10.55 E |
| 4,705,927 | 11/1987 | Levendusky et al. | 219/10.55 E |
| 4,713,510 | 12/1987 | Quick et al. | 219/10.55 E |
| 4,725,465 | 2/1988 | Lastovich | 426/124 |
| 4,797,010 | 1/1989 | Coelho | 383/109 |
| 4,904,488 | 2/1990 | LaBaw et al. | 426/107 |
| 4,943,456 | 7/1990 | Pollart et al. | 219/10.55 E |
| 4,973,810 | 11/1990 | Brauner | 219/10.55 E |
| 5,081,330 | 1/1992 | Brandberg et al. | 219/10.55 E |

FOREIGN PATENT DOCUMENTS

| | | | |
|---|---|---|---|
| 2320243 | 4/1977 | France | B65D 81/18 |

OTHER PUBLICATIONS

Litigation:Golden Valley Microwave Foods, Inc., v. Weaver Popcorn Inc. and American Packaging Corp., Civil Action No. F88-00251, (Aug. 22, 1988;N.D. Ind; J. Lee).

Product:BonnieLee TM Bag includes sheet susceptor between two plies but not bonded to outer paper ply.

*Primary Examiner*—Bruce A. Reynolds
*Assistant Examiner*—Tu Hoang
*Attorney, Agent, or Firm*—James V. Harmon

[57] ABSTRACT

The present invention provides an insulating microwave heating package with a multiplicity of latent, uninflated or potential insulation chambers capable of inflating when exposed to microwave energy. The package includes at least two superimposed inner and outer pieces of flexible sheet material bonded together at selected points, patches or along seal lines separated by unsealed areas which define side-by-side unfilled, i.e., potential, inflation chambers between the lines, patches or points. Upon exposure to microwave energy, the package and its contents become heated. As a result of this heating process, the unfilled chambers also become heated, causing them to become filled with hot expanding air or moisture vapor. These chambers serve as insulation for the package and enhance heating of the food by reducing heat loss from the package.

12 Claims, 3 Drawing Sheets

PACKAGE WITH MICROWAVE INDUCED INSULATION CHAMBERS

FIELD OF THE INVENTION

The present invention relates to packaging and more particularly to packaging for heating foods in a microwave oven.

BACKGROUND OF THE INVENTION

While many packages for heating food in a microwave oven have been successful, heat loss often interferes with achieving optimum results. For example, in popping corn, heat losses can reduce the volume of the popped corn and increase the number of "old maids", especially in low powered ovens. This can result in consumer dissatisfaction. Insulation for microwave packaging has in the past been bulky and requires assembly steps and materials which make the package more expensive. In addition, the insulation has been located only in the bottom portion of the package, i.e. the portion resting on the floor of the microwave oven, thereby reducing heat loss only in that area. One example is described in U.S. Pat. No. 4,219,573 which provides enough insulation to prevent the loss of at least about 18 cal. per gram of popcorn. It has now been discovered that excellent results can be provided by providing the loss of only about 9 calories per gram of popcorn. In addition, the insulation materials—cork, wood, corrugated pad or ceramic paper—proposed in U.S. Pat. No. 4,219,573 are not required in the present invention. This reduces the cost of the package substantially. Insulation previously used reduces the cooling rate of the food when the package is chilled or frozen. It has now been discovered that the microwave energy itself can be used to induce the formation in situ of an insulation structure without adding material to the package. In developing the present invention, it has also been discovered that the most efficient formation of the insulation structure can be achieved by augmenting the heat supplied by the microwave energy alone to the unformed potential insulation before the insulation structure actually comes into being.

In view of the deficiencies of the prior art, it is a major object of the invention to reduce the loss of heat from microwave packaging without increasing the cost of the package or adding materials, to reduce heat loss in one or more selected areas or throughout the entire package, thereby permitting foods contained in the package to be cooked or heated more efficiently and to enable the package to be chilled or frozen as efficiently as a bag with no insulation. Our prior U.S. Pat. No. 5,081,330 provides insulation chambers only in limited areas and in contact with a susceptor. A major objective of the present invention is to achieve even more effective insulation for the food during microwave heating than can be accomplished following the teachings of U.S. Pat. No. 5,081,330.

These and other more detailed and specific objects of the invention will be better understood by reference to the following detailed description and figures which illustrate by way of example but a few of the various forms of the invention within the scope of the appended claims.

SUMMARY OF THE INVENTION

The present invention provides an improved microwave heating package with a multiplicity of latent, uninflated or potential insulation chambers capable of becoming inflating when exposed to microwave energy. The package includes a package-enclosing wall having inflatable means in the wall adapted to expand the thickness of the wall upon exposure to microwave energy. In a preferred embodiment, the wall includes two sheets of material including at least one flexible sheet. The sheets are bonded together at selected points, patches or along seal lines with unsealed areas between them to define unfilled inflation chambers between the lines, patches or points. A microwave susceptor may be placed adjacent to some of the potential inflation chambers. Upon exposure to microwave energy, the package and its contents become heated. As a result of this heating process, the unfilled chambers between the patches, points or seal lines also become heated, causing them to become filled with heated air or vapor.

THE FIGURES

Examples of the Prior Art

FIG. 1 is a perspective view of one form of package disclosed in our prior U.S. Pat. No. 5,081,330;

Figure 4:
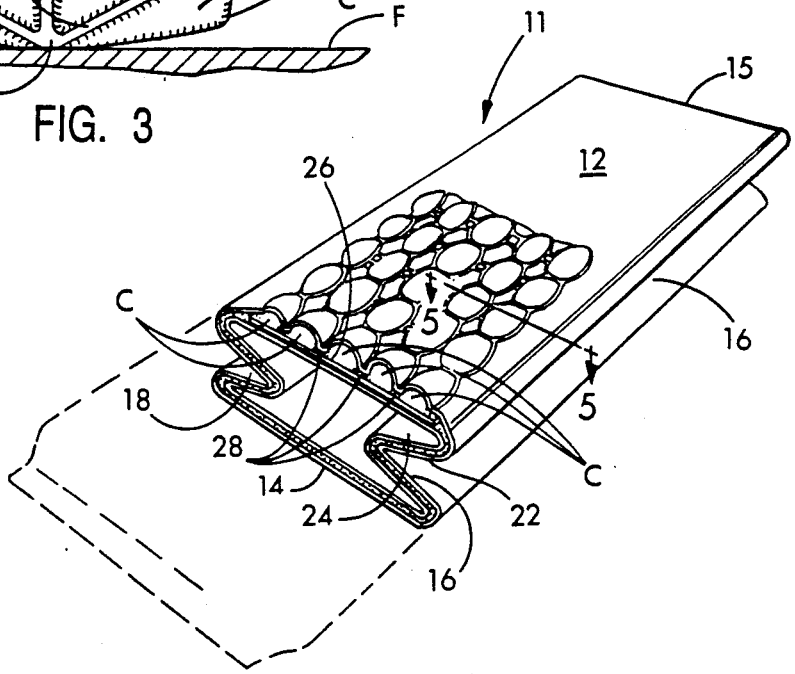
Figure 5:
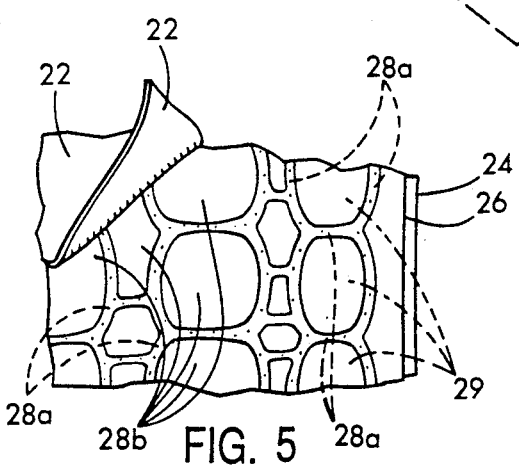
Figure 6:
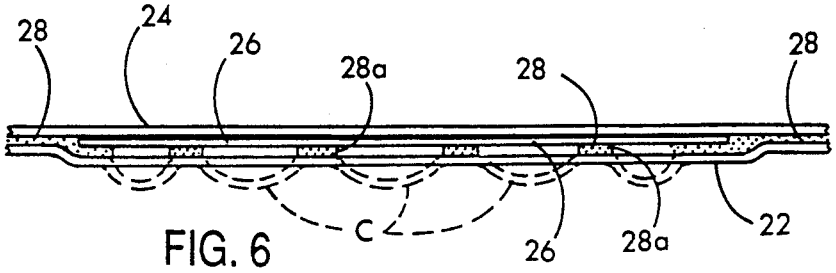

FIG. 4 is a perspective view partly broken away of another package described in our prior U.S. Pat. No. 5,081,330;

FIG. 5 is a partial transverse sectional view taken on line 5—5 of FIG. 4 with the outer wall of the package partially drawn back;

FIG. 6 is an enlarged cross-sectional view of a portion of a prior art package in accordance with U.S. Pat. No. 5,081,330 showing inflation chambers in unexpanded and expanded condition (dotted lines);

Examples of the Present Invention

Figure 7:
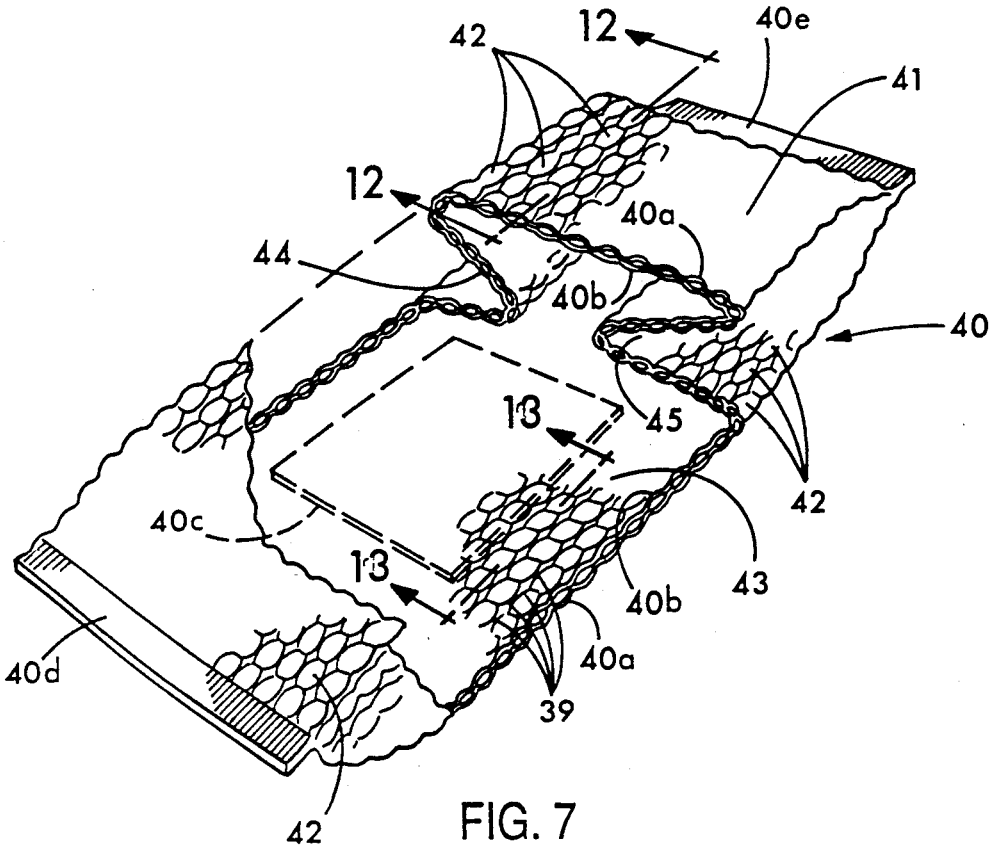

FIG. 7 is a perspective view of another form of the invention.

Figure 8:
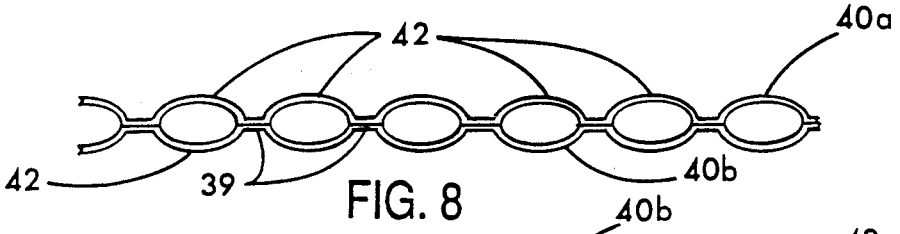
Figure 9:
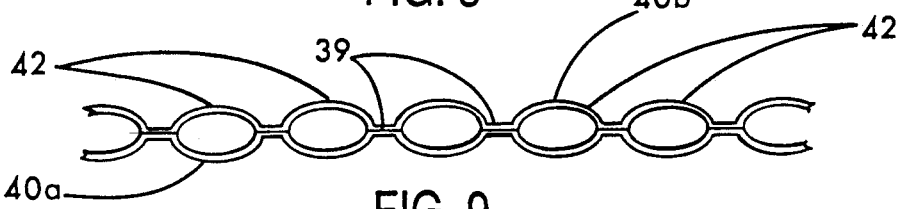
Figure 10:
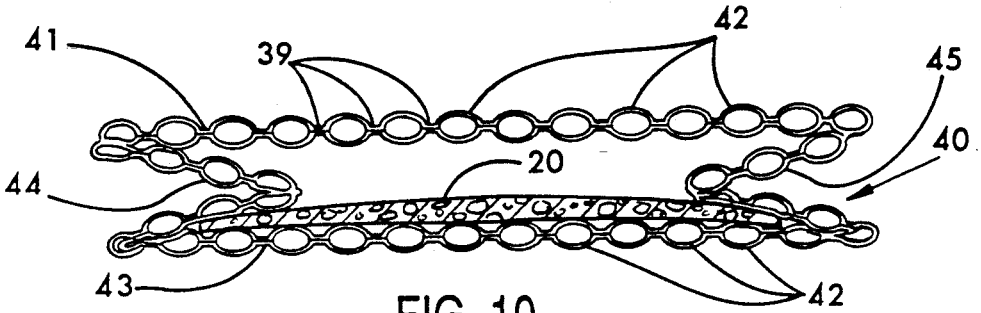

FIG. 8 is a cross-sectional view taken on line 8—8 of FIG. 7;

FIG. 9 is a cross-sectional view taken on line 9—9 of FIG. 7;

FIG. 10 is a cross-sectional view taken on line 10—10 of FIG. 7 after cooking has resulted in partial inflation of the package.

EXAMPLES OF THE PRIOR ART

Figure 1:
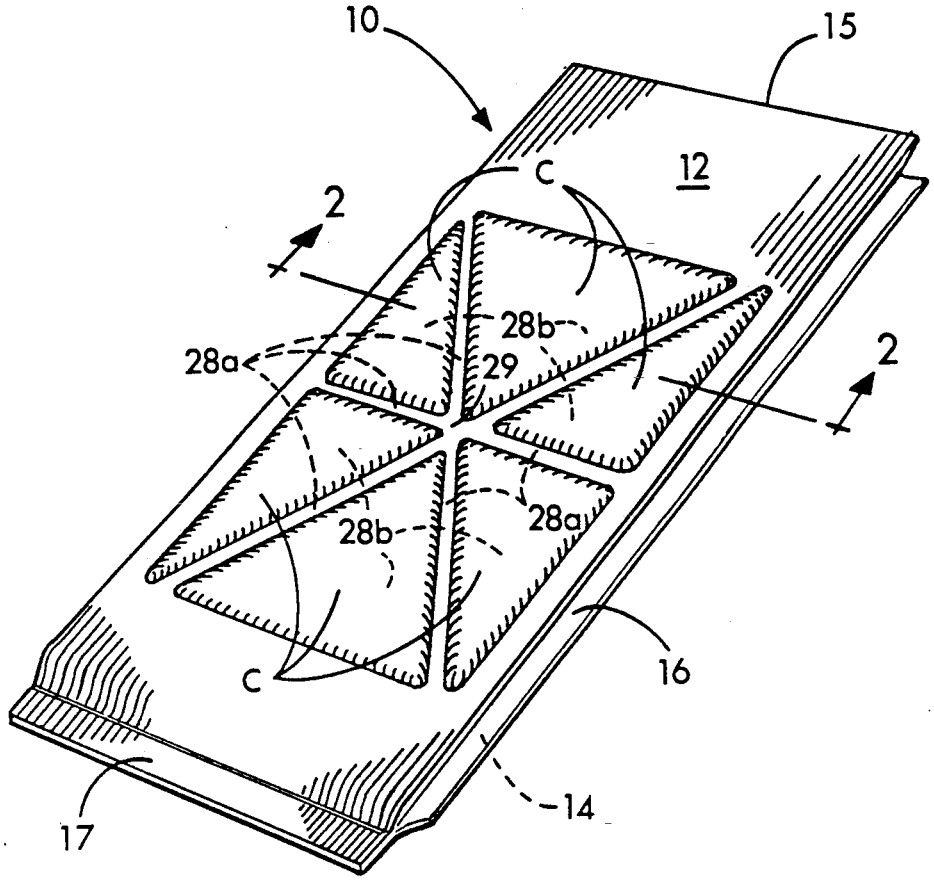
Figure 2:
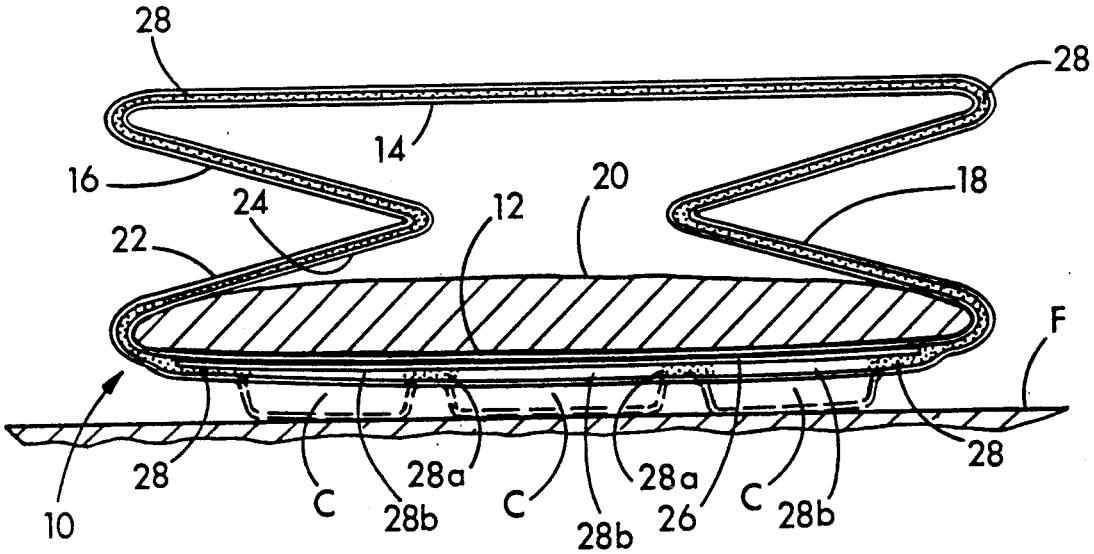
FIG. 2 is a transverse sectional view taken on line 2—2 of FIG. 1.
Figure 3:
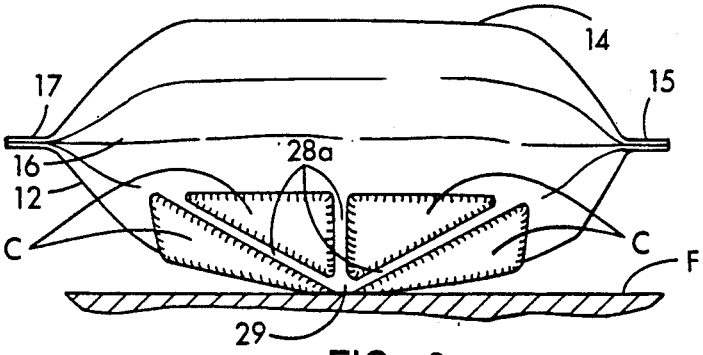
FIG. 3 is a side view of the package of FIG. 1 as it appears after being heated in a microwave oven.

FIGS. 1, 2 and 3 illustrate a prior art package, in this case a collapsible bag 10 as described in our prior U.S. Pat. No. 5,081,330. The bag 10 is formed from paper and includes a lower face 12, an upper face 14, gussets 16 and 18, and a bottom seal 17. Before the bag 10 is filled with food, it is open at one end which serves as a mouth 15. The bag 10 can be filled through the mouth 15 with any suitable food 20 such as a charge of unpopped popcorn and shortening which is to be popped within the bag 10 by microwave energy supplied by a microwave oven. The mouth 15 of the package is then sealed shut. The bottom wall or lower face 12 of the bag is shown in FIG. 1. During the popping operation the bag 10 is oriented so that the bottom wall 12 faces downwardly with the food 20 in contact with it as shown in FIGS. 2 and 3.

As can be seen in FIG. 2, the bag 10 is made up of flexible outer and inner layers of paper 22 and 24 which are glued, i.e. laminated, together by means of an adhesive 28. However, at least on the lower face 12 of the bag 10, the pattern of adhesive 28 is provided such that there exists a series of strips, dots or patches of adhesive 28*a* separated by areas with no adhesive 28*b*. This provides several latent or potential inflation chambers C. The sheets 22 and 24 can, for example, comprise 30 lb. bleached kraft paper and 30 lb. greaseproof kraft paper, respectively. The adhesive 28 can comprise a suitable heat-resistant adhesive such as a vinyl chloride emulsion adhesive, an ethylene vinyl chloride emulsion adhesive or a polyvinylacetate polymer emulsion adhesive such as Duracet-12® adhesive manufactured by Franklin International, Inc. of Columbus, Ohio. Other adhesives will be apparent to those skilled in the art. The adhesive 28*a* can be applied in any suitable manner, for example by a patterned adhesive applicator roll (not shown). No effort has to be made to provide a space or air chamber of any kind between the sheets 22 and 24 in the unsealed areas 28*a*. It is believed, however, that a small space exists and that a small amount of air will be present between the two sheets. The important requirement is simply that the sheets be unbonded in the areas 28*b*.

Between the inflation chambers C and the inner wall 24 of the bag 10 is a susceptor 26 of any suitable known construction, for example a flexible sheet of plastic film having a microwave interactive coating on one or both surfaces. The susceptor 26 may be located adjacent to the food 20 and the expandable chambers C may be on the opposite side of the susceptor 26 from the food 20 to maximize heat transmission to the food and minimize loss to the oven floor F. Microwave interactive susceptors of various compositions are well known to the art for heating food. Examples are described in U.S. Pat. Nos. 4,735,513; 4,878,765; 4,190,757 and 4,267,420. It will be seen in FIG. 2 that the sheets 22 and 24 are laminated together in flat condition. That is to say, with the adjacent surfaces at the location of the unbonded areas 28*b* which define the latent.

When a package having latent chambers C as described in U.S. Pat. No. 5,081,330 is heated in a microwave oven, the unsealed sections 28*b* will expand as the result of the expansion of air or moisture vapor or, most probably, both to produce inflated chambers C and create a microwave-induced layer of insulation between the food and the floor of the oven F. The chambers C are often about ¼" in height. The mechanism of expansion of these of chambers during microwave heating cannot be explained fully as a result of air expansion because no effort is necessary to assure that air is present in the unexpanded chambers. Moisture vapor may be partially responsible for the expansion of the chambers. The susceptor 26 typically reaches a temperature of about 325° F. to 400° F., and at this temperature, air and moisture vapor present in the unexpanded chambers can expand to ten times their original volume.

It will be noted that no additional material is required to provide the insulation chambers C. Moreover, the insulation layer provided by the chambers C does not rigidify the package as a layer of corrugated cardboard will do as described in U.S. Pat. No. 4,219,573. In addition, the food can be chilled or frozen as efficiently as in an uninsulated package.

As described in U.S. Pat. No. 5,081,330 by arranging the adhesive strips 28*a* in a star pattern which intersects at a center point 29 near the center of the bag 10, it has been discovered that the bag tends to develop a conical bottom surface that has an apex at the intersection point 29 of the adhesive bands 28*a*. This is desirable since it tends to clump the unpopped popcorn near the center of the bag during the popping operation, thereby keeping it at a location where heat can be transferred to it most effectively so as to enhance the popping effect. Thus, in this configuration, the chambers C tend to shape the package 10 and act as a conical truss or form for concentrating the charge of popcorn and shortening 20 at a center point. In an alternative form, if a series of elongated parallel chambers C are employed, they will help to unfold the bag 10 which is shipped in a folded condition as they inflate during the microwave heating process.

The susceptor 26, of U.S. Pat. No. 5,081,330 instead of comprising a separate sheet of material, can be a coating applied as a liquid to the outer surface of the inner sheet 24 and dried in the manner of a printing ink. In such a case, the susceptor coating will contain a microwave interactive heating substance in particulate form which is bonded to the sheet 24 as a part of the coating which makes up the susceptor 26.

Another form of the package in accordance with the prior art as described in U.S. Pat. No. 5,081,330 is shown in FIGS. 4, 5 and 6 wherein the same numerals refer to corresponding parts in the embodiment illustrated above. In this embodiment, the primary difference from FIGS. 1–3 is that the inflation chambers C have a different pattern In FIGS. 4–6, the inflation chambers C comprise a plurality of relatively small blisters arranged in rows.

As seen in FIGS. 4–6, the bag indicated generally at 11 includes a lower face 12, an upper face 14, gussets 16 and 18, and susceptor 26 as described above and in U.S. Pat. No. 5,081,330. Adhesive 28 is employed for bonding the sheets 22 and 24 together. In the area where the chambers C form during heating, the adhesive 28 is arranged as a plurality of circles of adhesive 28*a* having adhesive-free areas 28*b* between them. Before heating, the condition of the latent inflation chambers C is shown diagrammatically in FIG. 6 as narrow spaces between the circles of adhesive 28*a*. When the package is placed in a microwave oven and exposed to microwave energy, the heat produced by the microwave energy, and particularly that produced by the susceptor 26, will cause the latent or potential inflation chambers C corresponding to the adhesive-free areas 28*b* to expand as shown by dotted lines in FIG. 6 and solid lines in FIG. 4 to produce the inflation chambers C which provide an insulating effect for reducing heat loss from the food and the susceptor 26.

The prior art packages of FIGS. 1–6 can be used in connection with a variety of foods, such as popcorn, pizza, french fries, griddle food (e.g. french toast, pancakes, waffles), rolls, doughnuts and the like. Since the sheets of paper 22 and 24 are flexible, they are better able to conform to the surface of an irregularly shaped food product, such as the lower surface of a pizza crust, than a flat stiff object such as a sheet of corrugated cardboard. This promotes heat transmission into the food.

DETAILED DESCRIPTION OF THE INVENTION

Refer now to FIGS. 7–10 which illustrate the present invention. This embodiment comprises a package composed of a collapsible bag 40 formed from a pair of superimposed paper sheets comprising an outer paper sheet 40*a* and an inner paper sheet 40*b* which are bonded together by means of adhesive along spaced apart lines 39 arranged to form a series of rings, each of which has a generally hexagonal shape as best seen in FIG. 7. The adhesive used to bond the sheets 40*a*, 40*b* together along the seal lines 39 can comprise any suitable paper or plastic laminating adhesive known to the art, such as those described above or the adhesive described in U.S. Pat. No. 4,878,765. The sheets 40*a*, 40*b* can be of any suitable flexible packaging material transparent to microwave energy, such as plastic or paper sheets. When paper is used, the outer sheet can be bleached kraft paper of 30 lbs. per ream and the inner sheet can be a greaseproof kraft paper of 30 lbs. per ream when the package is used for popping popcorn. The sheet material can also be a combination of a liner composed of 25 lbs. per ream greaseproof kraft paper bonded to an outer layer of 30 lbs. per ream kraft paper. In the alternative, if desired, both layers can comprise 25 lbs. per ream kraft paper. For some applications, a lighter weight paper such as 23 lbs. per ream kraft paper can also be used for one or both plies of the package.

The bag 40 includes an upper face 41 and a lower face 43. As in the other embodiments, transversely extending end seals 40*d* and 40*e* are provided to seal each end of the bag, preferably by heat sealing the ends in any suitable manner through the application of transversely extending opposed heat sealing bars (not shown) which, through the application of heat and pressure across the end of each bag, provide the heat seals 40*d* and 40*e*. A suitable heat sealing adhesive such as that mentioned hereinabove or other known heat sealing adhesive can be used. One of the seals, e.g. 40*d*, is left open so that the bag can be filled with food 20 such as a quantity of unpopped popcorn and, optionally, shortening if desired and other food ingredients such as flavors. The bag is unexpanded and substantially flat (as shown in FIG. 1) after being filled. The seal 40*d* is then formed so that the entire bag 40 is sealed. If desired, a susceptor 40*c* can be laminated between the plies 40*a*, 40*b* in the lower panel 43 of the bag 40. The susceptor 40*c* can be of any suitable type, such as those described in U.S. Pat. Nos. 4,878,765 or 4,970,358 as well as hereinabove. Other suitable microwave susceptors will be apparent to those skilled in the art. The susceptor 40*c* comprises a patch of material that may be about 4 inches square or of any other suitable size to approximately equal the size of the food product 20. The food product 20 and the susceptor 40*c* should be positioned in alignment as is known to those skilled in the art. If the food heats effectively without the susceptor 40*c*, the susceptor can be eliminated.

During cooking, the lower face 43 of the bag 40 is placed to rest on the floor or bottom of a microwave oven. The upper face 41 is directed upwardly. The package is then subjected microwave heating. The package shown in FIGS. 11–14 is shown after a period of heating. However, prior to heating, the sheets 40*a*, 40*b* are flat and either in contact or almost in contact with one another throughout as shown in solid lines in FIG. 6. However, after heating in the microwave oven for a period of time, those portions of the package between the seal lines 39 inflate throughout the whole package or portions thereof to form a multiplicity of side-by-side expanded chambers 42. Thus, prior to heating, the spaces between the seal lines 39 provide flattened, i.e. uninflated, potential sites for the inflated chambers 42. During the microwave heating process, the flattened inflatable chambers are inflated by expanding gas and/or vapor to provide insulation for the package to help reduce heat loss and to thereby enhance heating of the food 20. Accordingly, because sheets 40*a*, 40*b* are transparent to microwave energy, the microwave radiation is able to enter the food 20 from all directions. However, after cooking, the heat in the package unlike in our prior U.S. Pat. No. 5,081,330 is much less able to escape and is thus trapped inside the package no matter which direction it attempts to escape due to the insulating effect of the expanded chambers 42 present in those locations where heat loss is possible.

The embodiments of FIGS. 7–10, unlike those described, in U.S. Pat. No. 5,081,330 contain an area of chambers in both the upper panel 41 and the lower panel 43. It will be seen, in this case as shown in FIG. 11, that the area of chambers within the upper panel 41 comprises substantially the entire upper panel 41. Similarly, the area of the chambers in the lower panel 43 comprises substantially the entire lower panel 43. Additionally, the gussets 44, 45 are provided with the inflatable chambers 42 and substantially the entire area of each of the gussets 44 and 45 is composed of the inflatable chambers 42. In the form of the invention shown, the entire upper panel 41, the entire lower panel 43, as well as the entire area of the gussets 44 and 45 are completely covered with the inflatable chambers 42. Thus, during heating in a microwave oven, the chambers 42 over the entire surface of the bag 40 can slowly begin to expand as the package is heated to form a package 40 in which the food 20 is surrounded on all sides by the heat insulating inflatable chambers 42. Of course, some of the chambers 42 may expand ahead of others and some may not expand at all if they are insufficiently heated. However, the chambers 42 throughout the entire bag 40 have the potential for expansion.

The sealed areas 39 can have other shapes and can comprise dots, patches or strips of adhesive of various shapes. They need not necessarily comprise closed rings, although the latter is preferred. In one typical package, the openings between the seals 39 are hexagonal openings about ⅜ inch across.

The invention thus provides a microwave heating package which is easy to produce and less expensive than a standard package since less adhesive is used. However, in spite of the smaller quantity of adhesive required for bonding the two superimposed sheets 40*a*, 40*b* together, the chambers C and 42 which inflate during the heating process provide improved insulation for the package, not only on the lower surface (panel 43) but also on the upper panel 41 and the gusset panels 44, 45. Once the heat enters, it tends to be trapped inside no matter in which direction it tries to escape.

The package is suited for heating a variety of foods such as hamburgers and other meat products, pizza pies, desserts, e.g. fruit pies, cobblers and other desserts that have a crust formed from dough, as well as pancakes, waffles, potatoes such as french fried potatoes and other foods.

Many variations of the present invention within the scope of the appended claims will be apparent to those skilled in the art once the principles described herein are understood.

What is claimed is:

1. An insulating microwave cooking package having a food compartment for containing food to be heated in a microwave oven, comprising:

inner and outer superimposed sheets of microwave transparent packaging material as a wall of the package;

said sheets of the package wall being sufficiently flexible to change shape during microwave heating;

seals connecting the inner and outer superimposed sheets together in selected sealed areas located between the sheets;

said seals defining a multiplicity of unsealed areas which provide multiple flattened inflatable chambers between the sheets and separate from said food compartment;

the inflatable chambers being adapted to expand when subjected to heat produced by the microwave oven without placing moisture or other expandable material therein prior to heating to provide a thermal barrier for reducing heat loss from the food compartment;

said package having parallel opposed upper and lower panels defining a top and a bottom surface of said package and gusset folds between said panels and a microwave heating susceptor connected to said lower panel;

said unsealed areas comprising a multiplicity of inflatable chambers within at least a portion of the package that includes said upper panel and said gusset folds to enhance cooking of the food by reducing heat loss therethrough.

2. The insulating package of claim 1 wherein the entire upper panel and the entire lower panel of said package contain said flattened inflation chambers.

3. The package of claim 1 wherein the package comprises a bag having a pair of laterally disposed, longitudinally extending, spaced apart gusset folds extending centrally toward one another between the upper and lower panels of the package to form centrally extending gusset and said unsealed areas comprise at least a portion of said gusset folds.

4. The package of claim 3 wherein said unsealed areas comprise substantially the entire area of said centrally extending gusset folds.

5. The package of claim 1 wherein the seals comprise a multiplicity of sealed dots, patches or lines between said inner and outer superimposed sheets making up said lower panel and wherein said dots, patches or lines cover substantially the entire lower panel whereby the entire bottom panel of the package comprises flattened inflatable chambers as potential sites for inflation by expanding gas and vapor during heating of the package in a microwave oven.

6. The package of claim 1 wherein the seals comprise a multiplicity of sealed dots, patches or lines between said inner and outer superimposed sheets making up said upper panel and wherein said dots, patches or lines cover substantially the entire upper panel whereby the entire upper panel of the package comprises flattened inflatable chambers as potential sites for inflation by expanding gas and vapor during heating of the package in a microwave oven.

7. The package of claim 5 wherein the superimposed sheets are sealed together by means of rings of adhesive to provide a multiplicity of closed chambers therebetween.

8. The package of claim 4 wherein the superimposed sheets are sealed together by means of rings of adhesive to provide a multiplicity of closed chambers therebetween.

9. The package of claim 2 wherein the superimposed sheets are sealed together by means of rings of adhesive to provide a multiplicity of closed chambers therebetween.

10. The package of claim 5 wherein the lower panel of the package has a microwave interactive susceptor for absorbing microwave energy to heat said susceptor and for transferring the heat therefrom to the food.

11. The package of claim 7 wherein the superimposed sheets are sealed together by lines of adhesive defining hexagonal rings of adhesive between said sheets.

12. The package of claim 1 wherein the seals between the superimposed sheets with spaces therebetween extend throughout substantially the entire package.

* * * * *

UNITED STATES PATENT AND TRADEMARK OFFICE

CERTIFICATE OF CORRECTION

PATENT NO. : 5,317,118
DATED : May 31, 1994
INVENTOR(S) : Brandberg et al.

It is certified that error appears in the above-identified patent and that said Letters Patent is hereby corrected as shown below:

Title page,
Item [*], Notice, reads:
"The portion of the term of this patent subsequent to Jan. 14, 2009 has been disclaimed." should read:
-- The portion of the term of this patent subsequent to July 11, 2010 has been disclaimed. --

Signed and Sealed this

Seventeenth Day of December, 2002

JAMES E. ROGAN
*Director of the United States Patent and Trademark Office*